United States Patent [19]

Greene

[11] Patent Number: 4,810,258

[45] Date of Patent: Mar. 7, 1989

[54] LOW RANK COAL OR PEAT HAVING IMPURITIES REMOVED BY A DRYING PROCESS

[75] Inventor: Monroe M. Greene, Butte, Mont.

[73] Assignee: Western Energy Company, Butte, Mont.

[21] Appl. No.: 128,210

[22] Filed: Dec. 3, 1987

Related U.S. Application Data

[60] Division of Ser. No. 796,727, Nov. 12, 1985, Pat. No. 4,725,337, Continuation-in-part of Ser. No. 677,868, Dec. 3, 1984, abandoned.

[51] Int. Cl.[4] ..... C10L 5/00; C10F 7/06

[52] U.S. Cl. ..... 44/33; 44/608; 44/622; 44/626; 44/627; 34/30

[58] Field of Search ..... 44/1 G, 1 SR, 27, 33, 44/626, 608, 620, 622; 34/30

[56] References Cited

U.S. PATENT DOCUMENTS

| | | | |
|---|---|---|---|
| 1,656,859 | 1/1928 | Jirotka | 44/27 |
| 4,052,168 | 10/1977 | Koppelman | 44/1 G |
| 4,059,060 | 11/1977 | Gambs et al. | 44/1 SR |
| 4,249,909 | 1/1981 | Comolli | 44/1 G |

*Primary Examiner*—Carl F. Dees

*Attorney, Agent, or Firm*—Leonard Bloom

[57] ABSTRACT

A low rank coal or peat has various impurities removed therefrom by a drying process. The impurities may be removed in a subsequent operation. The dried coal or peat will not absorb substantial moisture when stored or transported.

6 Claims, 5 Drawing Sheets

LOW RANK COAL OR PEAT HAVING IMPURITIES REMOVED BY A DRYING PROCESS

Cross-Reference To Related Application

This application is a division of application Ser. No. 796,727, filed Nov. 12, 1985 now U.S. Pat. No. 4,725,337 which is a continuation-in-part of co-pending application Ser. No. 677,868 filed Dec. 3, 1984, abandoned, the disclosure of which is incorporated herein in its entirety by reference.

FIELD OF THE INVENTION

The present invention relates to a process and an apparatus for removing water and impurities from low rank coals and peat; and more particularly, to an energy-efficient process and apparatus, whereby an improved coal or peat product, not found in nature, is obtained.

BACKGROUND OF THE INVENTION

The desirability of utilizing low rank coals such as the bituminous, sub-bituminous and lignite coals as a replacement for oil has long been recognized. However, many deposits of these coals have a high content of volatile constituents and water which detract from their economic value as a fuel. This is especially important in certain geographical areas, where the mined coal must be shipped over long distances. Additionally, such coals have a high content of impurities, such as sulfur, which make their use environmentally undesirable.

In the prior art, of which I am aware, various processes and apparatuses have been disclosed which have attempted to provide for the drying and purifying of low rank coals.

The most prominent process is the "Fleissner Process" disclosed in U.S. Pat. Nos. 1,632,829 and 1,679,078 both issued to H. Fleissner. The Fleissner process is a batch process which involves the use of saturated steam processing, under high pressure, to remove water from low rank coals. The Fleissner process has operated commercially in Europe to upgrade lignite since 1927.

Several attempts have been made to adapt the "Fleissner Process" for continuous processing. The United States Bureau Of Mines has developed such an adaptation wherein the continuous processing of lignites is performed at 1500 psig. See Oppelt, W. H., W. R. Kube and T. W. Kamps. "Drying North Dakota Lignite to 1500 Pounds Pressure by the Fleissner Process". BuMines RI 5527, 1959.

U.S. Pat. Nos. 4,052,168, 4,127,391 and 4,129,420 all issued to Koppelman also teach adaptations of the "Fleissner Process" for upgrading lignites, bituminous fines and cellulosic materials, respectively. In each of these processes, the desired matter is dried by autoclave treatment for, preferably, 15 minutes to one hour at very high pressures (1,000–3,000 psi) and very high temperatures (750° F. minimum with 1,000°–1,250° F. being preferable). Each of these processes are directed particularly to batch-type autoclaves.

U.S. Pat. Nos. 4,126,519 issued to Murray discloses an apparatus and method for thermal treatment of organic carbonaceous material. Utilizing a highly specialized apparatus, carbonaceous material in the form of a slurry is preheated and then dried at elevated temperatures (950° F.) and pressures (1,495 psig). The efficiency and capacity of this '519 patent is severely limited by the moisture content present in the material sought to be dried. Moreover, the waste water extracted from the equipment contains environmentally undesirable dissolved organic constituents, which necessitates treatment of the waste water.

U.S. Pat. No. 4,477,257 also issued to Koppelman discloses an apparatus and process for thermal treatment of organic carbonaceous materials. Utilizing a highly specialized apparatus in this complicated process, before drying, the material is first subjected to a preheating stage for 3–60 minutes requiring temperatures of 300°–500° F. and a pressurized dewatering stage. The material is then dried in a reaction stage for 1–60 minutes at high temperatures (400° F.–1,200° F.) and high pressures (300–3,000 psi).

U.S. Pat. No. 3,977,947 issued to Pyle discloses a continuous process for the drying and carbonizing of particulate woody materials. Particulate woody marerials are injected on a continuous basis into a gas fluidized bed of previously carbonized materials. The particulate woody material is dried and carbonized to form a solid pyrochar on the surface of the bed. Off-gases with entrained charcoal fines are removed from above the bed and separated in a cyclone system whereby a gaseous fuel is obtained.

U.S. Pat. No. 3,520,795 issued to Schulman, et al teaches a process for retorting oil shale employing externally generated superheated steam in a once through mode. In particular, that process is directed to control of temperatures while eliminating the use of a substantial amount of recycle gas streams in oil shale retorting. That process is also concerned with the use of liquid cooling streams in retorting of oil shale.

U.S. Pat. No. 4,291,539 issued to Potter discloses a power plant wherein steam generated from burning coal in a boiler drives a high-pressure turbine. De-superheated steam from the turbine is then channeled to a dryer where, in the absence of all other gases, it is used to dry moist coal. The dried coal is then utilized to further fuel the boiler. In this process the "dirty steam" generated from drying the coal is vented to the atmosphere. The drying is essentially a "once through mode".

Other prior art patents known to the applicant are as follows:

| No. | Inventor(s) | Year of Issue |
|---|---|---|
| 2,579,397 | Roetheli | 1951 |
| 3,001,916 | Cheadle | 1958 |
| 3,061,524 | Savage | 1962 |
| 3,112,255 | Champion | 1963 |
| 3,133,010 | Irish, et al. | 1964 |
| 3,441,394 | St. Clair | 1969 |
| 3,463,623 | Forney, et al. | 1969 |
| 4,104,129 | Fields, et al. | 1978 |
| 4,158,697 | Cramer | 1979 |
| 4,162,959 | Duraiswamy | 1979 |
| 4,274,941 | Janssen, et al. | 1981 |
| 4,278,445 | Stickler, et al. | 1981 |
| 4,331,529 | Lambert, et al. | 1982 |
| 4,359,451 | Tipton | 1982 |
| 4,366,044 | Swanson | 1982 |
| 4,383,912 | Saadi, et al. | 1983 |

Additionally, the processes utilized for treating lignite have been summarized in a publication by the United States Department of Energy, Technical Information Center. See Stanmore, B., D. N. Baria and L. E.

Paulson, "Steam Drying Of Lignite": A review of Processes and Performance", 1982.

While the processes and apparatus disclosed in the prior art for drying and purifying low rank coals and peat are widespread, these process and apparatuses have several disadvantages and deficiencies, which have severely limited their use, and which may be enumerated as follows:

First, the processes disclosed are carried out using extremely high pressures. Such high pressure requirements demand an energy input which generally make those processes economically undesirable. For example, the Bureau of Mines process is performed at 1,500 psig, while the Koppelman processes require pressures of 1,000–3,000 psi with the higher pressures being preferable. These high pressure requirements also severely reduce the flexibility of those processes and increase the inherent risks and dangers associated therewith.

Second, the processes of the prior art are all carried out using extremely high temperatures. For example, the Koppelman processes disclose preferable temperatures of 1,000° F.–1,200° F. Such high temperature requirements demand an energy input which aids in rendering those processes economically undesirable.

Third, the processes of the prior art require that the matter to be dried be subjected to the aforementioned high temperatures and pressures for prolonged periods of time (referred to as residence times). For example, the Koppelman processes disclose usual residence times of from 15 minutes to one hour. These extended residence times not only increase the amount of energy input into the system, but also reduce the amount of product which can be processed over a given period of time, thereby further rendering those processes economically undesirable.

Fourth, the processes disclosed require specialized and expensive equipment, apparatuses, and facilities which increase capital investment and production costs, thereby further rendering those processes economically undesirable.

Fifth, the processes of the prior art generally do not provide capabilities to sufficiently remove impurities such as ash, sulfur and pyrite from the coal. Therefore, to comply with federal, state and local environmental regulations, it has become customary in the prior art to mix the fuels produced by those processes with imported low sulfur fuels to provide a residual blend having a lower sulfur content. The high cost of importing such fuels further renders these processes economically undesirable.

Sixth, the processes of the prior art (such as the aforementioned Murray patent) produce waste water which contain environmentally undesirable dissolved organic constituents. To comply with environmental regulations, such waste water must be treated requiring additional equipment, facilities and time, thereby increasing the costs involved with those processes and rendering them economically unfeasible.

Finally, in the processes of the prior art, hydrocarbons are evaporated along with the drying gases in concentrations which are too low to economically permit recovery. Accordingly, these gases are evaporated to the atmosphere. Consequently, these processes are environmentally undesirable.

SUMMARY OF THE INVENTION

Accordingly, it is an object of the present invention to alleviate the disadvantages and deficiencies of the prior art by providing energy efficient processes for the drying and purifying of low rank coals and peat which are economically and environmentally desirable and feasible.

It is another object of the present invention to provide processes for the drying and purification of low rank coals and peat which are performed at low pressures and reduced temperatures.

It is yet another object of the present invention to provide processes and apparatuses for the drying and purification of low rank coals and peat, which require a low input of energy.

It is still yet another object of the present invention to provide apparatuses for the drying and purification of low rank coals and peat which are simple and require low capital investment costs.

It is a further object of the present invention to provide dried low rank coal and peat which has an increased heat value per unit weight, which retains a substantial portion of its volatile content, which is substantially free from impurities and which will not absorb substantial moisture when stored or transported.

It is a yet further object of the present invention to provide a substantially dried low rank coal which has a substantially reduced weight, whereby the transportation costs are reduced.

It is a yet still further object of the present invention to provide a system for drying and purifying low rank coal, wherein all of the major components of the system are readily available, and wherein major equipment need not be custom fabricated.

In accordance with the teachings of the present invention, a process for the substantial drying of low rank coal is provided. Low rank coal is subjected to a superheated gaseous medium, thereby substantially desorbing the moisture from the coal and producing superheated gases from the drying process. A substantial portion of the superheated gases is recycled back in contact with coal being dried. As the process is monitored, sufficient heat is added to the recycled superheated gases so that they are maintained in a substantially superheated condition throughout.

In a preferred embodiment, a process for the substantial drying of low rank coal is initiated by subjecting coal to superheated steam, thereby substantially desorbing moisture from the coal and producing superheated gases. These superheated gases include combustible light hydrocarbon gases from the drying process. A substantial portion of the superheated gases is recycled back in contact with coal being dried. A minor portion of the recycled superheated gases is drawn off, and the combustible portions thereof are used as a fuel for heating purposes. The process is monitored, and sufficient heat is added to the recycled gases, so that these gases are maintained in a substantially superheated condition throughout.

In the processes presented, the volume of hydrocarbons evaporated along with the drying gases is substantially reduced.

The low rank coal dried in accordance with this process has a substantially improved heat value per unit weight, and retains a substantial portion of its volatile content. This coal has also had its moisture substantially removed and has been reduced in size. Furthermore, the coal will not absorb substantial moisture when stored or transported.

In another aspect of the present invention the process of the above-disclosed preferred embodiment is conducted for the substantial drying of peat.

In accordance with the further teachings of the present invention, a process for removing a substantial portion of the impurities from low rank coal is provided. The coal is subjected to a superheated gaseous medium, thereby desorbing a portion of impurities from coal, and thereby liberating a substantial portion of impurities from coal. Superheated gases are also produced from the drying process. A substantial portion of the superheated gases is recycled back in contact with coal being dried. The process is monitored, and sufficient heat is added to the recycled gases so that they are maintained in a superheated condition throughout.

This process removes a substantial portion of sulfur impurities from the coal. In the drying process, a portion of the organic compounds is desorbed. Also, a substantial portion of the inorganic sulfur compounds is liberated.

In a preferred embodiment, a process for removing a substantial portion of the impurities from the low rank coal is initiated bysubjecting coal to superheated steam. A portion of the impurities is desorbed from the coal, and a substantial portion of the impurities is liberated from the coal. Superheated gases are also produced from the drying process. A substantial portion of the superheated gases is recycled back in contact with coal being dried. The process is monitored, and sufficient heat is added to the recycled gases so that they are maintained in a superheated condition throughout.

In another embodiment of the present invention, the process further includes cooling the dried coal and subjecting the dried cooled coal to density separation, thereby physically separating pyrite and ash-forming constituents from the cooled dried coal.

In another aspect of the present invention, the above-described embodiments are utilized for removing a substantial portion of the impurities from peat.

In accordance with the yet further teachings of the present invention, an apparatus for the substantial drying of low rank coal is provided. Means are provided for moving low rank coal into a drying means. A generator of a superheated gaseous medium is provided, and means are further provided for passing the superheated gaseous medium from the generator into the drying means, thereby initiating the drying process, and thereby substantially drying the coal and producing hot gases which exit from the drying means. Means is provided for recycling a substantial portion of the hot exit gases back into the drying means. Means for monitoring the composition of the exit gases is provided; and means are further provided for reheating the recycled exit gases in response to the monitoring means, whereby the exit gases and the recycled gases are maintained in a superheated equilibrium condition.

In a preferred embodiment, an apparatus for the substantial drying of low rank coals is provided. The apparatus includes a drying means and means for moving the low rank coal into the drying means. The apparatus further includes a generator of superheated steam; and means are provided for initiating the drying of the coal by passing superheated steam from the generator into the drying means, thereby substantially drying the coal, and thereby producing hot gases which exit from the drying means. Respective means are provided for recycling a substantial portion of the hot exit gases back into the drying means; for monitoring the composition of the exit gases; and for reheating the recycled exit gases in response to the monitoring means, whereby the exit gases and the recycled gases are maintained in a superheated equilibrium condition.

Preferably, the drying means comprises a vibratory fluidized bed dryer.

In yet another embodiment, the preferred apparatus is further provided with means for cooling the dried coal and means for continuously moving the dried coal from the drying means into the cooling means. A vibratory pneumatic density separator, whereby pyrite and ash forming constituents are separated from the coal, is provided, as well as means for moving the dried coal from the cooling means to the vibratory pneumatic density separator.

In another aspect of the present invention, the above-described apparatuses can equally be utilized for the substantial drying of peat.

In accordance with the still further teachings of the present invention, a low rank coal is subjected to an energy-efficient drying process which substantially removes the moisture from the coal. As a result, the size of the coal is reduced; the heat value per unit weight of the dried coal is increased; and the dried coal will not absorb substantial moisture when subsequently stored or transported. Also, the impurities in the coal are substantially desorbed and/or liberated free of the coal during the drying process, so that they may be removed therefrom by a subsequent operation.

In a preferred embodiment, the improved low rank coal also retains a substantial portion of its volatile content.

In another aspect of the present invention, peat is subjected to an energy efficient drying process which substantially removes the moisture from the peat. As a result, the size of the peat is reduced; the heat value per unit weight of the dried peat is increased; and the dried peat will not absorb substantial moisture when subsequently stored or transported. Also, the impurities in the peat are substantially desorbed and/or liberated free of the coal during the drying process, so that they may be removed therefrom by subsequent operation.

These and other objects of the present invention will become apparent from a reading of the following specification taken in conjunction with the enclosed drawings.

DESCRIPTION OF PREFERRED EMBODIMENTS

It is to be understood that the term "low rank coals" as herein employed and as set forth in the subloined claims, broadly encompasses a series of relatively low rank or low grade carbonaceous materials or coals inc-luding peat, the lignite coals (which encompasses lignite and brown coal), the sub-bituminous coals (conventionally classified as rank A, B and C in order of their heating values), and the bituminous coals. Occassionally, peat has also herein been referred to separately.

Figure 1:
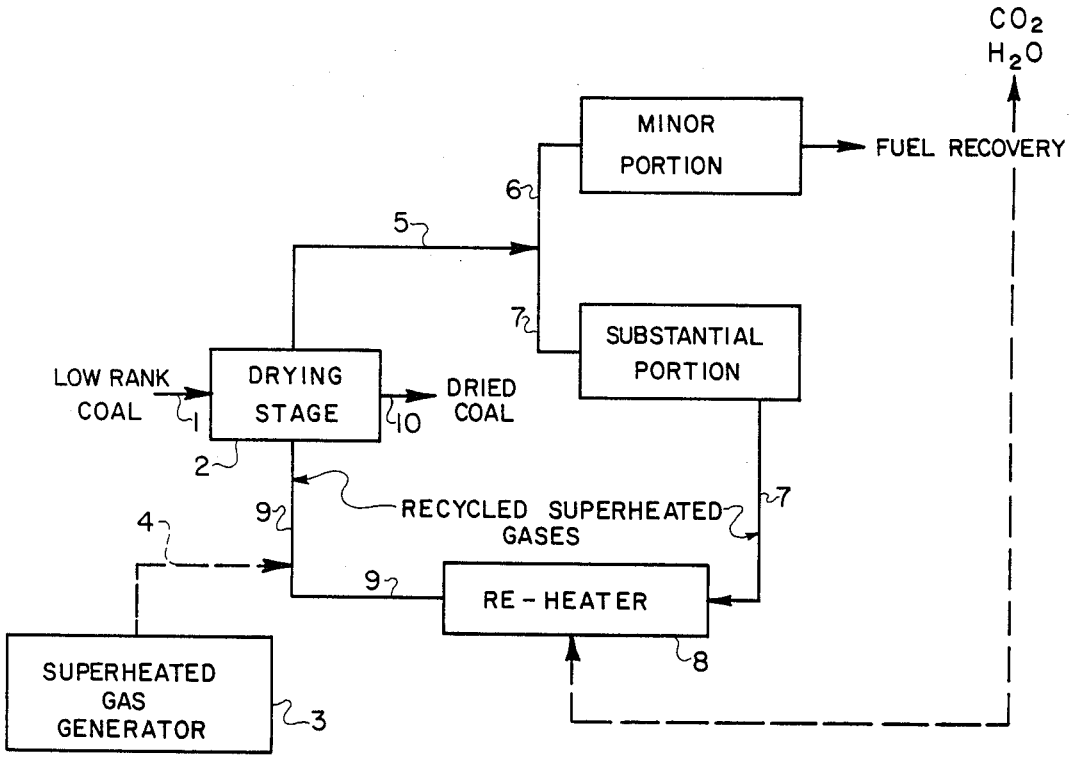
FIG. 1 is aschematic diagram of the process for drying coal of the present invention, wherein superheated gases are utilized for initiating the drying process, and wherein a substantial portion of the gases are recycled into the drying stage and are reheated to maintain the gases in a superheated condition.
Figure 2:
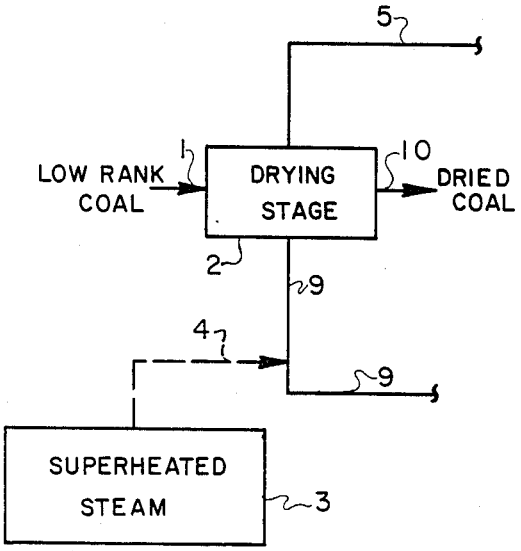
FIG. 2 is a schematic diagram corresponding to a portion of FIG. 1, wherein the superheated gases are superheated steam.
Figure 3:
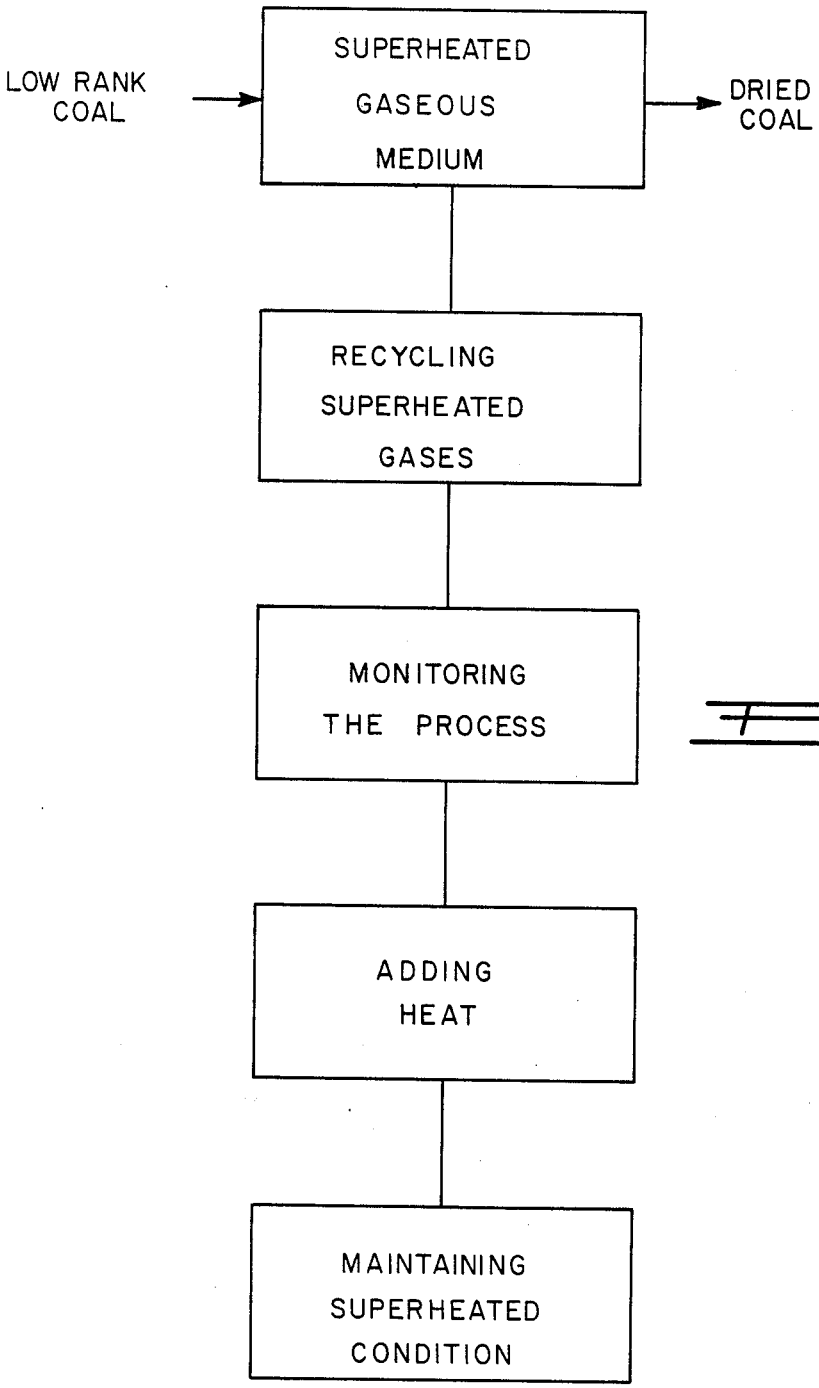
FIG. 3 is a flow chart, schematically illustrating the drying process of the present invention.

With reference now to the drawings, and with particular reference to FIGS. 1–3, there is illustrated a preferred embodiment of the energy efficient drying process of the present invention. This embodiment represents a continuous, low-pressure single-stage coal drying system.

Prior to start-up, the dryer system is purged of air until the oxygen content is nearly zero. The system is then preheated by recirculating the inert purge gas to prevent condensation within the dryer system. Nitrogen or externally produced steam can be used for purging.

Low rank coal is initially prepared by the normal practices of the mine from which it is obtained. The coal is then crushed and ground to, preferably, 2-inch size, nominal. For best economics in the practice of this invention, the fines, middle and larger fractions of the crushed coal should then be segregated for separate processing. However, it is to be understood that crushing and separating is not required for successful operation of this invention.

Crushed, ground, low rank coal is fed continuously along a conveyor (illustrated schematically by line 1) into a drying means 2 at a controlled rate. Therein, the drying process is initiated by subjecting the coal to a superheated gaseous drying medium. The superheated gaseous medium utilized to initiate the process is generated by a superheated drying medium generator 3 (which can be a superheated gas generator) and passes into the drying means through conduits 4 and 9, respectively. The broken lines indicate that the generator 3 is used to initiate the drying process; and thereafter, is effectively "disconnected" from the system.

As can be seen by reference to FIG. 2, in the preferred embodiment, the superheated gaseous medium utilized to initiate the drying process is superheated steam.

Returning to FIG. 1, in the preferred embodiment, the temperature of the gaseous drying medium initiating this process is 850° F. and 15 inches water column pressure, (approximately 0.541 psi) although any temperature above the dew point of the superheated gaseous medium will suffice.

When the coal is subjected to the drying medium, heat is transferred from the gas to the coal particles, thereby increasing the temperature of the coal particles to at least 300° F. for good drying and vaporizing the more troublesome low boiling temperature hydrocarbons. In practice, heating the coal to approximately 450° F. is preferred.

The preferred temperature is a control on the stability of the final product and needs to be high enough to destroy the carboxyl groups present in the coal. This produces the most stability, highest heat value and the highest desirable volatile content in the product.

As a consequence of the aforementioned heat transfer, moisture is substantially desorbed from the coal and superheated gases are produced. In the preferred embodiment, the temperature of these superheated gases is approximately 350° F. at 5 inches water column pressure (approximately 0.18 psi). These superheated gases exit from the top of the dryer means through conduit 5.

The composition of the exit gases is monitored when exiting the drying means 2. Preferably, this monitoring consists of measuring the carbon dioxide content of the superheated gases. However, it is understood that the present invention is not so limited, and that any suitable measurement can be utilized to monitor the process.

The composition of the superheated gases exiting the dryer has, for sub-bituminous coal, been found to be approximately: 75% $H_2O$ vapor, as steam; 20% $CO_2$; 0.3% organic sulfer compounds; 4.2% organic volatiles; and 0.5% other gases, such as $O_2$ and $N_2$.

In the preferred embodiment, approximately 5% of the total volume of the superheated exit gases is comprised of new distillates desorbed from the coal. This minor portion is drawn off from the process through conduit 6 and is recovered for use as a heating fuel. As illustrated in FIG. 1, a portion of this recovered fuel can be utilized to power a reheater 8. It will be appreciated by those skilled in the art that this is a continuous process. Accordingly, it will be appreciated that this minor portion is not necessarily the exact same gases that are evolved, but, rather, that this minor portion is merely equivalent to the same amount.

A substantial portion of the superheated exit gases is drawn through conduit 7 for recycling. While in the preferred embodiment, approximately 95% of the superheated exit gases is recycled, recycling between 70–95% of these exit gases has been found to produce favorable results. It should be noted, however, that as the volume of exit gases being recycled is decreased, the portion of exit gases drawn off for recovery will increase proportionally. It will be appreciated by those skilled in the art that the percentage recycled is dependent on the composition of the material being processed and the static volume of the equipment only.

During recycling, a substantial portion of the particulate matter within the superheated gases is separated therefrom (by means not depicted in FIGS. 1–3). Additionally, the pressure of the gases being recycled is increased to, preferably, 25 inches water column pressure (approximately 0.902 psi).

As noted above, the composition of the exit gases are monitored when exiting the drying means 2. Preferably, this monitoring consists of measuring the carbon dioxide content of the superheated gases. Depending upon the coal being dried, there is a particular predetermined level or content of the carbon dioxide in the gases which is desired to be maintained throughout both the contact zone (contacting step) and the recycle loop (circuit).

In response to the monitoring of the process hereinbefore described, the superheated exit gases being recycled are then reheated in a reheater 8, so that the gases arr maintained in a substantially superheated equilibrium condition throughout both the contact zone and the recycle loop. When the measured content of carbon dioxide in the gases exiting the dryer means 2 is below the particular predetermined content desired therein, then energy input to the gases being recycled in reheater 8 is increased, thereby raising the temperature of those gases. These higher temperature gases are then recycled back in contact with the coal in the contact zone, contributing to more complete drying by decarboxylation of the coal by decomposition of the humic acid radical. This decomposition releases, inter alia, carbon dioxide. In this fashion, heating increases the content of carbon dioxide in the gases exiting the drying means to the desired predetermined level. When the measured content of carbon dioxide in the gases exiting the dryer means 2 is above the particular predetermined content desired therein, then the energy input to the gases being recycled in reheater 8 is decreased, thereby lowering the temperature of those gases. These lower temperature bases are then recycled back in contact with the coal in the contact zone, contributing to less decarboxylation of the coal by decomposition of the humic acid radical, thereby decreasing the level of carbon dioxide being released. In this fashion, lowering the heat decreases the content of carbon dioxide in the gases exiting the drying means to the desired predetermined level. In the preferred embodiment, the recycled superheated gases are reheated to a temperature of 850° F. at 15 inches water column pressure (approximately 0.541 psi) when they are recycled through conduit 9 and back in contact with coal being dried. The dried coal is continuously removed from the drying means by a suitable conveyor (indicated schematically at 10), preferably in a substantially plug-flow mode.

The residence time of the coal within the dryer varies according to its particle size. The optimum residence times have been found to be: less than fifteen (15) minutes for coal particles which are 1"–2" in size; less than eight (8) minutes for coal particles of 20 mesh to 1" in size; and less than three (3) minutes for coal particle fines less than 20 mesh. Because the largest particle establishes the residence time required to complete drying of all particles, economy for large scale processing is best realized by segregating particle sizes for separate processing.

A desirable feature of the above-described method is its ability to operate at low pressure. That is, it has a required operating pressure of only 5 inches water column pressure (approximately 0.18 psi) plus the pressure drop of the recirculated drying system. However, it is to be understood that, preferably, this method can be operated at as high as 50 inches water column pressure (approximately 1.8 psi). Although it is understood that this process could be operated at higher pressure, albeit a pressure substantially less than that of the prior art.

Figure 4:
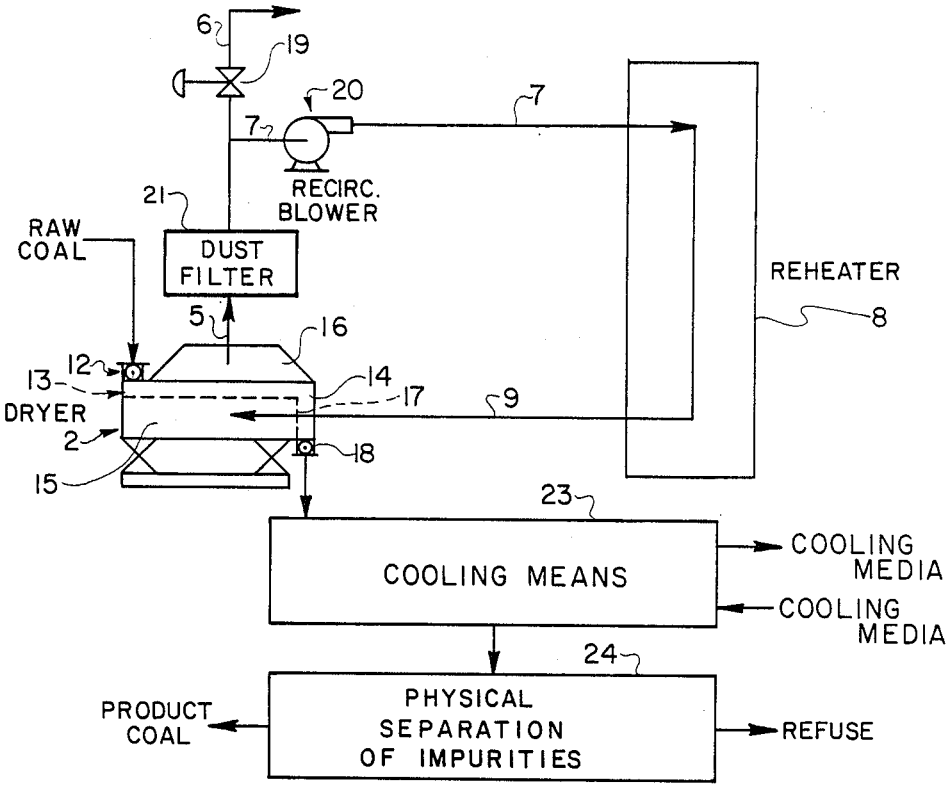
FIG. 4 is a schematic diagram of the apparatus used in carrying out the process of the present invention.
Figure 5:
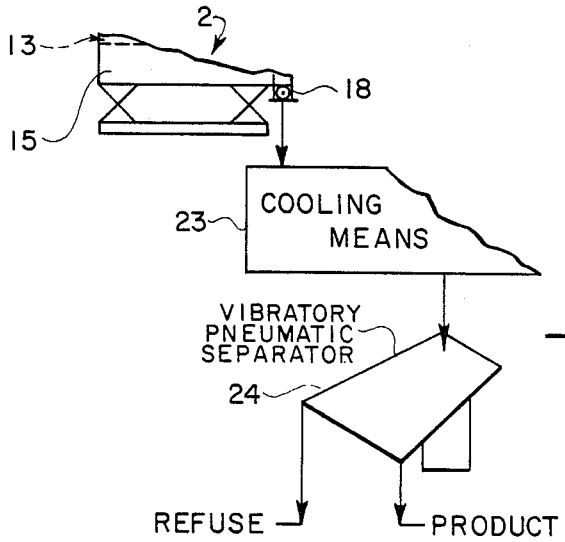
FIG. 5 corresponds to a portion of FIG. 4, but illustrates a preferred embodiment for the physical separation of impurities.
Figure 6:
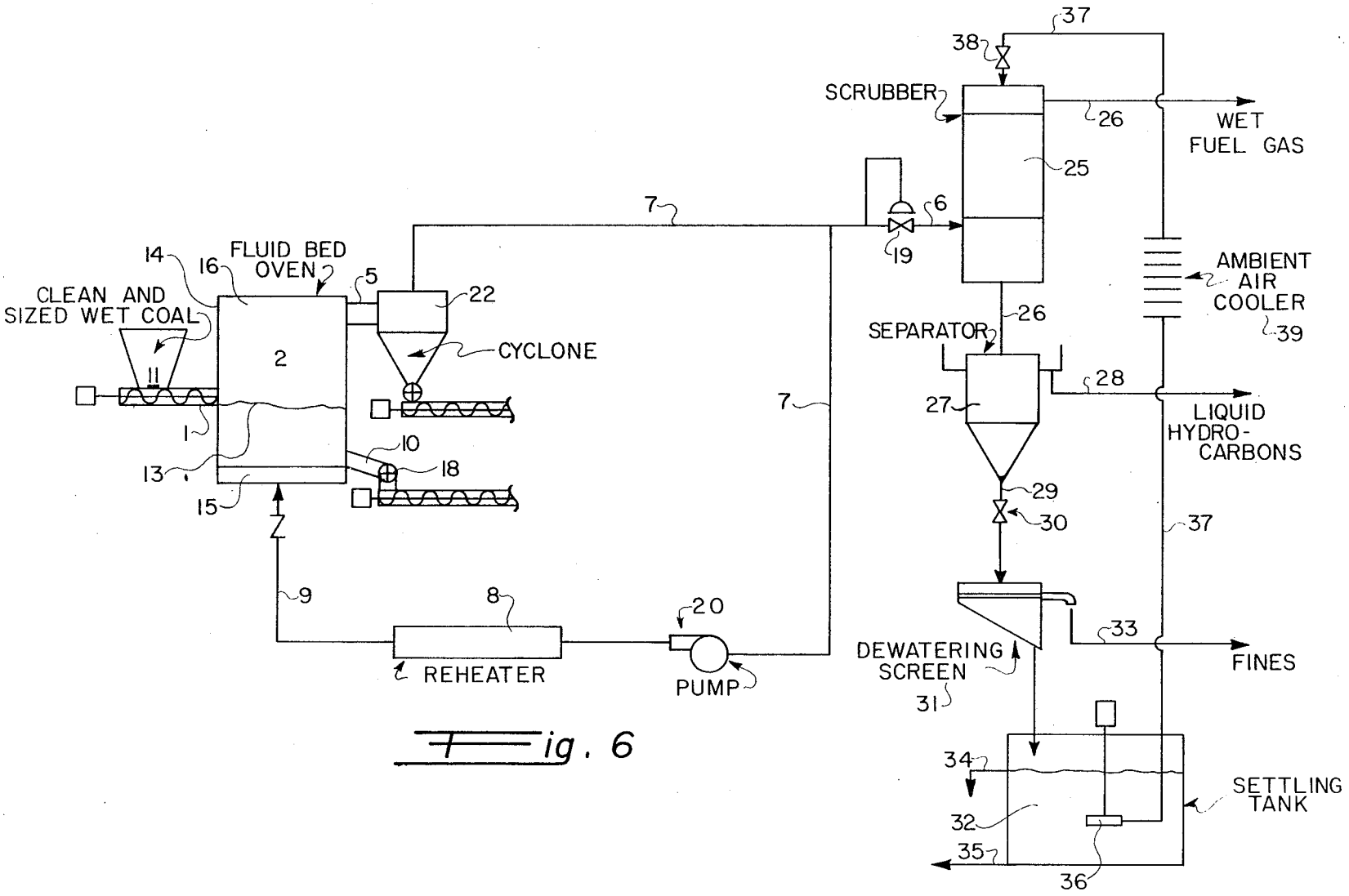
FIG. 6 is a schematic diagram of another embodiment of the apparatus and process of the present invention, further illustrating a recovery system used in connection with the apparatus and process.

With reference to FIGS. 4–6, there is illustrated a preferred embodiment of the apparatus of the present invention. This embodiment also represents a continuous, low-pressure single-stage coal drying and purification system and apparatuses therefor.

The drying stage occurs within a drying means 2. In the preferred embodiment, this drying means is a dryer and, more particularly, a vibratory fluidized bed dryer (see FIG. 6). It is also understood that a fluidized bed dryer, deep bed fluidized dryer, a vibratory deep bed fluidized dryer, or any other suitable drying means, can be used. However, the fluidized bed dryer has been found to be the most efficient. The dryer is to be insulated for thermal efficiency.

Crushed, cleaned coal is fed from conventional feeding equipment 11 (as indicated schematically by 1) into the drying means through a rotary air-lock 12. There, it is received on a loading end of a conveyor deck 13 which is encased in a jacket 14 to retain the gases. The conveyor deck 13 is comprised of either a perforated plate or longitudinal bars spaced to provide a well-distributed flow of the gaseous media through the fluidized bed. Below the deck is a plenum (or chamber) 15 which serves as a reservoir to facilitate uniform flow of gases through the fluidized bed. Above the deck is a discharge plenum 16. Both plenums are designed to reduce poor distribution of the gaseous media with low pressure drop of approximately 10 inches water column pressure, in the preferred embodiment.

The discharge end of the deck 13 is equipped with a weir (dam) 17 which fixes the depth of the fluidized bed. Because the coal flow is substantially plug-flow, the residence time established by the particle size of the coal being dried is controlled by feed rate displacement, which forces discharge of the coal over the weir 17. The hot, dry coal then drops into the rotary air lock 18 for exiting from the dryer 2.

It will be appreciated that the initial superheated drying medium is generated by the generator 3 (of FIG. 1) and passes through conduits 4 and 9, respectively, and into the lower plenum 15 of the dryer 2. Once in the dryer 2, the superheated medium passes through the openings of the deck 13. The medium then comes in contact with the coal particles being dried, transferring heat thereto, and driving off water and other constituents as gases and particle fines. The materials driven off mix with the superheated medium and exit the dryer from the upper plenum 16 through conduit 5.

In one embodiment, illustrated in FIG. 4, upon exiting the dryer 2, the exit gases are drawn off through conduit 7 and passed through a dust filter 21 where the fine particulate matter therein is removed. A minor portion of the exit gases is then drawn off through contact valve 19 into conduit 6 and is carried to a recovery system. A substantial portion of the exit gases is drawn off through conduit 7 where the pressure is increased by a recirculation blower 20.

In another embodiment, illustrated in FIG. 6, a cyclone separator 22 is utilized to separate the fine particulate matter from the exit gases. Upon exiting the dryer 2, the exit gases pass into a cyclone separator 14. In the cyclone separator, the fine particulate matter is separated from the exit gases. The exit gases then are drawn into conduit 7. A minor portion of the exit gases, in excess of the recycling volume, is drawn off through a contact valve 19 and into conduit 6 via a recovery system. A substantial portion remain in conduit 7, where the pressure is increased by pump 20.

The filtered, recycled gases are then passed through conduit 7 into a reheater 8 where, in response to the monitoring step, the recycled gases are reheated. The reheated gases are then recycled through conduit 9 into the lower plenum 15 of the dryer 2. There, the recycled gases are brought in contact with coal being dried.

With reference again to FIGS. 4 and 5, the hot dry coal exits the dryer 2 through a rotary air lock 18 and passes into a cooling means 23. In the preferred embodiment, the hot, dry coal is received on a porous, breathing, conveyor deck positioned within the cooler 23. This conveyor can also be a vibrating deck. There, the hot, dry coal is conveyed and exchange cooled, by direct contact with a suitable cooling media.

The cooler 23 is maintained at a slightly higher pressure than the dryer 2 so that leakage is directionally towards the dryer 2 where it will have little or no deleterious effect. The dried coal is cooled to preferably 80° F. at discharge from the cooler 23. Under these conditions, the rate of cooling is extremely rapid, thereby stabilizing the coals retention of high heating organic constituents required for proper volatility. The rapid cooling also results in the fracture release of ash forming inorganic constituents from the coal.

The dried, cooled coal is discharged from the cooler 23 through a rotary air lock and onto, preferably, a vibratory pneumatic density separator 24 (FIG. 5), wherein the physical separation of impurities from the coal is carried out. As will be understood by those skilled in the art, this separator 24 can also be a pneumatic separator, a hydraulic separator or a vibratory hydraulic separator. About 50% of the ash-forming constituents and virtually all of the inorganic sulfides are separated from the cooled, dried coal on the separator 24. The cleaned coal moves down off the separator as finished coal product, where it is collected for use. The higher density material is refuse, which, separate from the coal, moves off the separator, where it is collected and properly disposed.

With reference to FIG. 6, a system is illustrated for recovering fuel (for heating) from the drawn-off minor portion of the exit gases. The drawn off, minor portion of the exit gases is delivered through conduit 6 to a conventional scrubber 25 where the gases are condensed. The scrubber emits a noncondensible high BTU fuel gas fraction exiting through a conduit 26, which fraction is dried and desulfurized in conventional equipment (not shown). The condensed liquid flows from the scrubber 25 to a separator 27 via conduit 26.

Lighter insoluble liquid hydrocarbons are decanted from the separator 27 for recovery along line 28. The suspended solid fines are carried through conduit 29, having a valve 30, and are screened via dewatering screen 31. As a result, liquid in a clarified aqueous phase flows to vessel 32, while fine are carried off via passage 33.

In the vessel 32, excess aqueous liquid containing water soluble hydrocarbons overflows into conduit 34 for further processing and recovery. The hydrocarbon insolubles heavier than water are decanted (as at 35) for further processing and recovery. In the preferred embodiment, this vessel 32 is a settling tank.

The liquid required for use in the scrubber 25 is pumped via pump 36, from an intermediate level of the vessel 32, so that the heavy water insoluble hydrocarbons decanted along line 35 are substantially uninvolved, and further so that the lightest water soluble hydrocarbons exiting through conduit 34 are similarily uninvolved. The liquid pumped from the vessel 32 is delivered to scrubber 25 via conduit 37 having valve 38. Prior to delivery, this liquid is passed through an ambient air cooler 39, where the liquid is cooled for use in the scrubber 25.

It should be noted that while all of the above described embodiments illustrate continuous, single-stage coal drying processes, these methods and apparatuses are equally applicable to single and multiple stage batch processes, as well as multiple stage continuous processes.

All of the equipment and components illustrated schematically herein are readily available, and no major specialized equipment is necessary to carry out the objects of the present invention.

Figure 7:
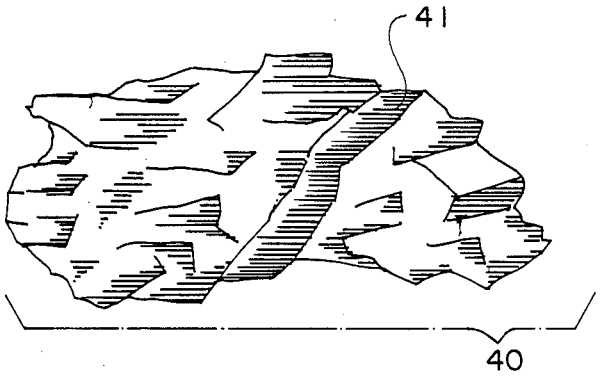
FIG. 7 is a perspective of a piece of low rank coal before undergoing the drying and purifying processes of the present invention.
Figure 8:
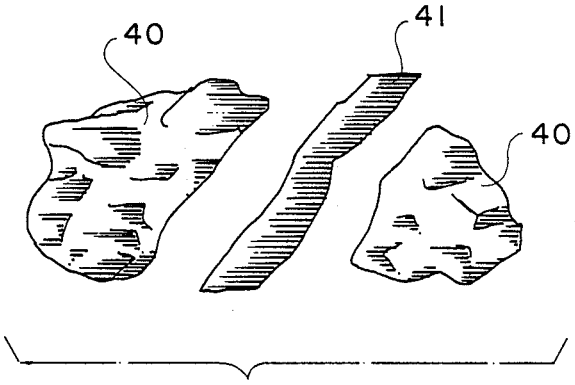
FIG. 8 is an exploded perspective of the separated coal of FIG. 7 after the processes cf the present invention; showing how a substantial portion of the impurities have been physically separated from the coal; and further showing how the moisture has been removed from the coal, and the dried coal has shrunk in size.

With reference to FIGS. 7–8, there is illustrated the low rank coal before (FIG. 7) and after (FIG. 8) being dried and purified by the processes and apparatuses of the present invention.

Before drying and purification, as illustrated in FIG. 7, the low rank coal 40 contains moisture and numerous impurities 41 such as sulfur pyrite. During the drying process, moisture and a portion of the organic sulfur compounds are substantially desorbed from the coal. Also, low boiling temperature hydrocarbons are vaporized. Additionally, a substantial portion of inorganic sulfur compounds is liberated and fracture release of the ash forming constituents occurs.

After the drying process, the dried coals are rapidly cooled. During this rapid cooling, the dried coal undergoes further facture release of approximately 50% of the ash forming inorganic compounds in the coal. Almost all of the pyritic sulfides are also released. As illustrated in FIG. 8, these impurities physically separate from the coal and are mechanically separated therefrom by means of a vibratory pneumatic density separator (as shown in FIG. 5) so that a purified coal product may be collected.

The processes of the present invention have been designed for low rank coal and peat with water contents of up to 55%. They can also be utilized with coals and peat having even higher water content. In the practice of this invention, an improved coal or peat, not found in nature, is produced which has several beneficial characteristics over the undried coals and peat.

The coal drying and purification process of the present invention has been demonstrated on a pilot scale with more than 200 tons of coals processed since August of 1984. The sub-bituminous coal was mined from the Rosebud seam in the State of Montana. The lignite was mined from a deposit near Miles City, Mont. The raw coal feed was typical of the current product of those mines and the practices used therein. Two examples are shown below:

EXAMPLE 1

Coal type—Sub-bituminous
Process Coal Temperature—600° F.
Process Pressure—10 inches of water column
Percentage of $CO_2$in Off-gas—20% (approx.)
Percentage Recirculation—96%
Average Particle Size—¾"
Residence Time—7.7 minutes

| | Input | Output |
|---|---|---|
| Weight | 235 lb. | 160 lb. |
| % Moisture | 25.3 | 1.6 |
| % Volatile Matter | 29.0 | 38.6 |
| % Ash | 9.1 | 7.0 |
| % Sulfur | 0.9 | 0.4 |
| Btu/lb. | 8,600 | 12,175 |

EXAMPLE 2

Coal Type—Lignite
Process Coal Temperature—600° F.
Frocess Pressure—10 inches of water column
Percentage of $CO_2$ in Off-gas—20% (approx.)

Percentage Recirculation—93%
Average Particle Size—¾"
Residence Time—7.7 minutes

| | Input | Output |
|---|---|---|
| Weight | 280 lb. | 168 lb. |
| % Moisture | 34.3 | 2.7 |
| % Volatile Matter | 24.8 | 43.8 |
| % Ash | 6.9 | 6.9 |
| % Sulfur | 0.5 | 0.3 |
| Btu/lb. | 7,069 | 11,103 |

As can be seen from the above data, the coal dried by the processes and apparatuses of the present invention have numerous benefits over the undried coal or peat. These benefits may be enumerated as follows:

First, water content of the dried coal or peat is significantly reduced. The water content of these coals includes water of hydration compounded molecularly within the coal. Though not completely understood, it is believed that the complete drying is dependent on molecular changes within the coal. The most important of these is the decomposition of the humic acid radical simultaneously releasing $CO_2$ and $H_2O$. Elimination of this heat consuming radical achieves a dry basis heating valve increase in the coal.

Second, high BTU value organic compounds are retained in the coal. Thus, the heat value per unit weight of the dried coal is increased. Indeed, heating values in the dried coal have been increased from as low as 5,500 BTU per pound, as mined, to more than 12,000 BTU per pound.

Third, the percentage of volatile matter of the coal is increased. Thus, ignitability required to use such coal in existing combustion equipment is retained. This further increases the desirability of the dried coal.

Fourth, the weight of the dried coal is substantially reduced by about one-third. The shipping costs are in the order of 2 cents per ton of coal shipped per mile. If, as is common, 100 cars full of the dried coal having a capacity of 100 tons/car are shipped 1,000 miles (approximately the distance from Montana to Illinois) a savings in one-third of the shipping costs (that is, approximately $67,000) is realized *per shipment* from the use of the processes and apparatuses of the present invention. This is a significant savings, heretofore not available in the prior art.

Fifth, ash forming constituents and impurities are easily separated from the coal during this process yielding a purer, more environmentally desirable product. Half of the sulfur and ash forming constituents present in the coal are removed, including substantially all of the pyritic inorganic sulfides, without the need for fine grinding o the use of heavy media which are presently employed. As a result, expensive pollution control equipment may not be required when the dried coal is burned in a power plant.

Sixth, the coal particles shrink, the resultant bulk density being 55 lbs. per cubic foot, the same as before drying. This permits existing rail cars to be used at full-load design capacity. This further saves costs associated with shipping the dried coal to its ultimate destination for consumption, thereby making the overall process even more economically desirable.

Seventh, the dried coal resists rehydration, permitting open car shipment and unprotected outdoor pile storage as presently practiced with undried coal.

Obviously, many modifications may be made without departing from the basic spirit of the present invention. Accordingly, within the scope of the appended claims, the invention may be practiced other than specifically disclosed herein.

What I claim is:

1. In a low rank coal of the type subjected to a drying process which substantially removes the moisture of the coal, wherein the size of the coal has been reduced, and wherein the heat value per unit weight of the dried coal has been increased, wherein the improvement comprises the coal being thermochemically treated without any mechanical size reduction process by contacting the coal with a superheated gaseous medium including water vapor, organic volatiles and carbon dioxide to heat the coal to a temperature of greater than 300° F. but less than a temperature at which substantial devolatalization would occur, therby producing a substantially purified coal product being substantially free of moisture, carboxyl groups and humic acid radicals, such that the coal has an increased dry basis heating value, the impurities in the coal having been substantially liberated free from the coal during the drying process, so that said impurities may be removed therefrom by a subsequent operation, and wheren the dried coal includes water of hydration compounded molecularly therein, such that the coal is hydrophobic and will not absorb substantial moisture when stored or transported.

2. The coal of claim 1, wherein the dried coal retains a substantial portion of its volatile content.

3. The coal of claim 1, wherein the impurities comprise ash forming constituents.

4. The coal of claim 1, wherein the impurities comprise pyrites.

5. A low rank coal subjected to a drying process which substantially removes the moisture of the coal, wherein the heat value per unit weight of the dried coal is increased, wherein the improvement comprises the coal being thermochemically treated without any mechanical size reduction process producing a substantially purified coal product being substantially free of moisture, carboxyl groups and humic acid radicals, such that the coal has an increased dry basis heating value, the pyrite and ash forming constituents in the coal being substantially liberated free of the coal during the drying process, so that said impurities may be removed therefrom by a subsequent operation, wherin the dried coal retains a substantial portion of its volatile content, and wherein the dried coal includes water of hydration compounded molecularly therein, such that the coal is hydrophobic and will not absorb substantial moisture when stored or transported.

6. Peat subjected to a drying process which substantially removes the moisture of the peat, wherein the heat value per unit weight of the dried peat is increased, wherein the improvement comprises the peat being thermochemically treated without any meachanical size reduction process producing a substantially purified peat product being substantially free of moisture, carboxyl groups and humic acid radicals, such that the peat has an increased dry basis heating value, the pyrite and ash forming constituents in the peat being substantially liberated free of the peat during the drying process, so that said impurities may be removed therefrom by a subsequent operation. the dried peat retains a substantial portion of its volatile content, and wherein the dried peat includes water of hydration compounded molecularly therein, such that the peat is hydrophobic and will not absorb substantial moisture when stored or transported.

* * * * *